US009843149B1

(12) United States Patent
Irbe et al.

(10) Patent No.: US 9,843,149 B1
(45) Date of Patent: Dec. 12, 2017

(54) FOLDABLE POWER STRIP

(71) Applicant: COLEMAN CABLE, LLC, Waukegan, IL (US)

(72) Inventors: Trisha Irbe, Pleasant Prairie, WI (US); Daniel Sabato, Gurnee, IL (US); Shiao-Tsun Ku, Fishers, IN (US)

(73) Assignee: COLEMAN CABLE, LLC, Waukegan, IL (US)

( * ) Notice: Subject to any disclaimer, the term of this patent is extended or adjusted under 35 U.S.C. 154(b) by 0 days.

(21) Appl. No.: 15/268,103

(22) Filed: Sep. 16, 2016

(51) Int. Cl.
*H01R 25/00* (2006.01)
*H01R 27/02* (2006.01)
*H01R 31/00* (2006.01)
*H01R 33/00* (2006.01)

(52) U.S. Cl.
CPC ..... *H01R 25/003* (2013.01)

(58) Field of Classification Search
CPC ..... H01R 13/645; H01R 35/04; H01R 39/64; H01R 39/00; H01R 39/28
USPC ..... 439/640, 652
See application file for complete search history.

(56) References Cited

U.S. PATENT DOCUMENTS 4,959,021 A 9/1990 Byrne
6,220,889 B1 4/2001 Ely et al.
6,786,734 B2 9/2004 Yu
7,112,097 B1 9/2006 Lam
7,374,425 B1 5/2008 Kuo et al.
7,488,204 B2 * 2/2009 Hsu ..... H01R 25/003 439/106
D597,948 S * 8/2009 Bizzell ..... D13/139.1
7,625,241 B2 * 12/2009 Axland ..... H01R 25/006 439/640
7,808,761 B2 10/2010 O'Rourke
8,157,574 B2 * 4/2012 Hsiao ..... H01R 13/4532 439/131
8,262,399 B1 * 9/2012 Zien ..... H01R 25/003 439/188
9,147,985 B1 9/2015 Noriega
9,484,692 B2 * 11/2016 Irons ..... H05K 7/1492
9,525,252 B2 * 12/2016 Kim ..... H01R 25/003
(Continued)

FOREIGN PATENT DOCUMENTS

DE 20313536 U1 12/2003
EP 2228872 A1 9/2010
JP 2005071850 A 3/2005

OTHER PUBLICATIONS

English Machine Translation of German Publication No. DE20313536 (Ahoku Electronic Company), Published Dec. 18, 2003.

(Continued)

*Primary Examiner* — Abdullah Riyami
*Assistant Examiner* — Thang Nguyen
(74) *Attorney, Agent, or Firm* — Patzik, Frank & Samotny Ltd.

(57) ABSTRACT

A foldable power strip having a pair of housing members having one or more outlets thereon and being rotationally connected together about a hinge or vertical axis. A power cord housing is also connected about the hinge or vertical axis to permit the housing members and power cord to be independently rotated relative to one another. The inside walls of the housing members may include side members that define a recess for receiving and protecting the power cord when the housing members are in the closed position.

14 Claims, 6 Drawing Sheets

(56) References Cited

U.S. PATENT DOCUMENTS

| | | | | |
|---|---|---|---|---|
| 2012/0028505 | A1 | 2/2012 | Weber et al. | |
| 2012/0108101 | A1* | 5/2012 | Hu | H01R 24/22 439/527 |
| 2012/0282805 | A1 | 11/2012 | Ku et al. | |
| 2013/0102174 | A1* | 4/2013 | Brown | H01R 35/04 439/218 |
| 2013/0337662 | A1 | 12/2013 | Lopez et al. | |
| 2014/0102870 | A1 | 4/2014 | Zien et al. | |
| 2014/0144670 | A1* | 5/2014 | Irons | H01R 13/5841 174/86 |
| 2014/0187079 | A1* | 7/2014 | Zien | H01R 13/514 439/490 |

OTHER PUBLICATIONS

English Machine Translation of Japanese Publication No. JP2005071850 (Kawasaki Electric Wire), Published Mar. 17, 2005.

* cited by examiner

FOLDABLE POWER STRIP

FIELD OF THE INVENTION

This invention relates generally to power strips and still more particularly to foldable power strips.

BACKGROUND OF THE INVENTION

Power strips are prevalently used to provide power to a number of different electrical devices attached thereto. Because of the different locations and applications where such power strips may be used, it has been known to have power strips of varying sizes and shapes. However, these devices have fixed power cords and do not permit adjustment of the power strip and cord into different positions relative to one another. This leads to a consumer having to purchase multiple power strips or be inconvenienced by the size or shape of the power strip and the location of the cord extending outward therefrom.

BRIEF SUMMARY OF THE INVENTION

The present invention comprises a foldable power strip having components that move relative to one another about a hinge or axis to allow positioning of the power strip and cord in a number of different configurations to adjust to the environment of where the power strip is used. The power strip comprises a pair of housing members hingedly connected together for rotation between an elongated open position and a folded, closed position, with the ability to be positioned at a number of positions between the open and closed positions. The power strip includes an annular ring that receives a power cord and is positioned within a hinge coupling two power strip housing members, to permit the power strip members and power cord to each be independently rotated relative to one another. The housing members may also include side members on their inside walls that include arcuate sections that together define a recess or groove for receiving the power cord therein to protect it when the power strip housing members are in the closed position.

Accordingly, it is an object of the present invention to provide a foldable power strip that is economical and easy to manufacture and use.

Yet another object of the present invention is to protect the power cord connection to the power strip when in the closed position.

Still another object of the present invention is to provide a power strip that is adjustable into a number of different positions for use in a variety of different locations.

A further object of the present invention is to provide a foldable power strip that allows for the power cord to be independently rotated relative to the power strip members.

Other objects, features and advantages of the invention will be apparent from the following detailed disclosure, taken in conjunction with the accompanying sheets of drawings, wherein like reference numerals refer to like parts.

DETAILED DESCRIPTION OF THE INVENTION

Figure 1:
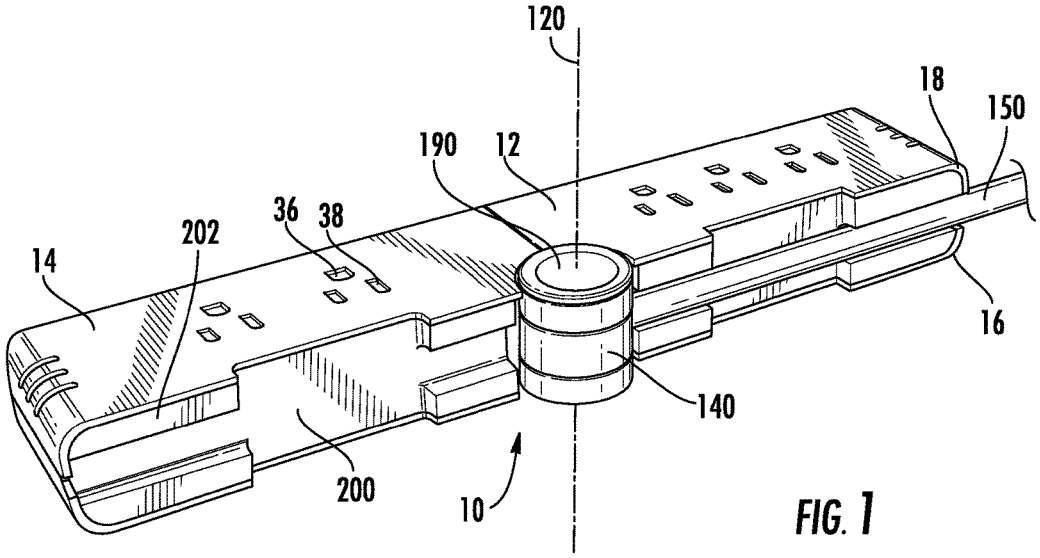
FIG. 1 is a perspective view of one embodiment of the foldable power strip of the present invention in the open or extended position, with the power cord extending laterally along the power strip housing.

While this invention is susceptible of embodiment in many different forms, there is shown in the drawings and will herein be described in detail several specific embodiments, with the understanding that the present disclosure is to be considered merely an exemplification of the principles of the invention and the application is limited only to the appended claims.

Figure 2:
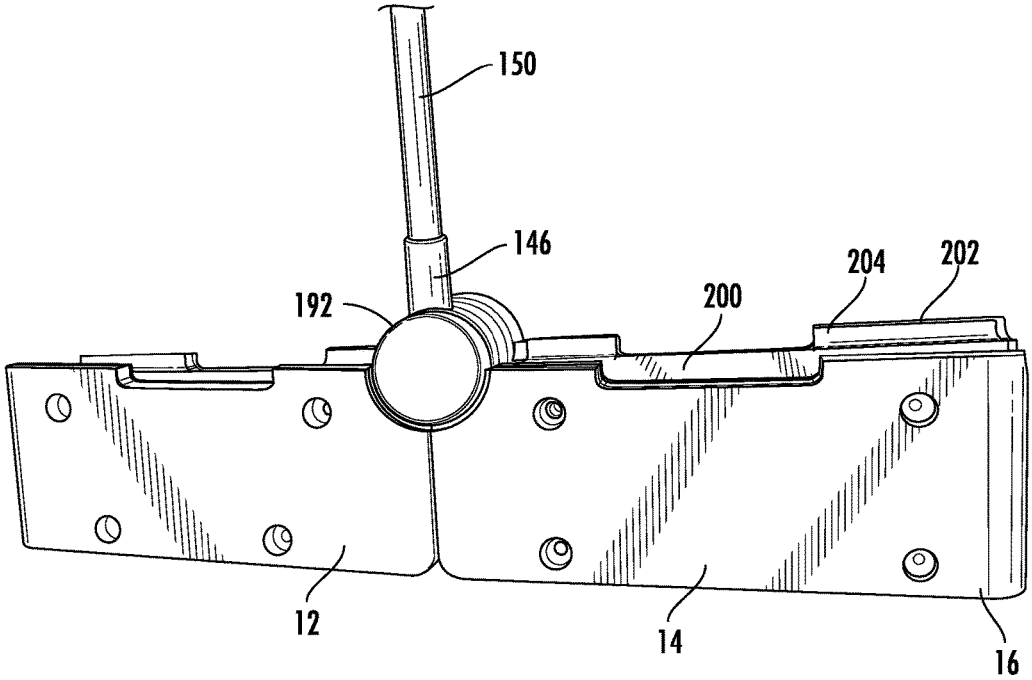
FIG. 2 is a perspective view of the foldable power strip of FIG. 1 with the power cord extending generally perpendicularly to the power strip housing.
Figure 3:
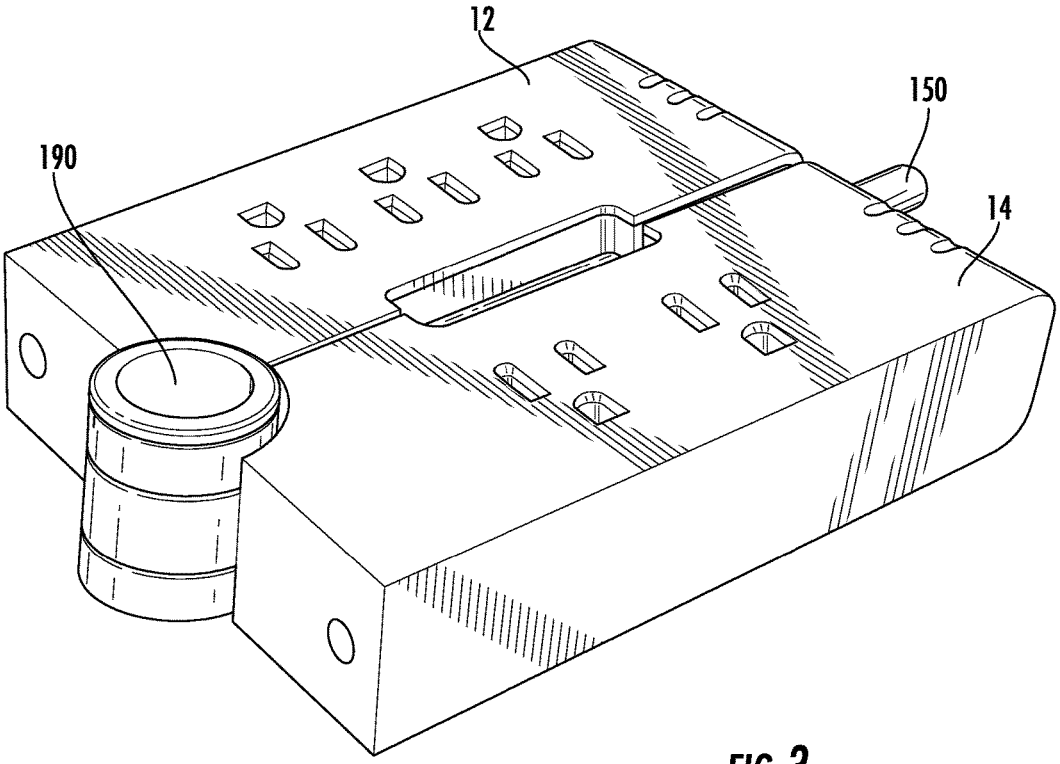
FIG. 3 is a perspective view of the foldable power strip of FIG. 1 in the closed position.

FIGS. 1 and 2 show one embodiment of the foldable power strip 10 of the present invention having a first housing member 12, a second housing member 14 and a power cord assembly 140 separately pivotable relative to one another about a vertical axis 120.

Figure 4:
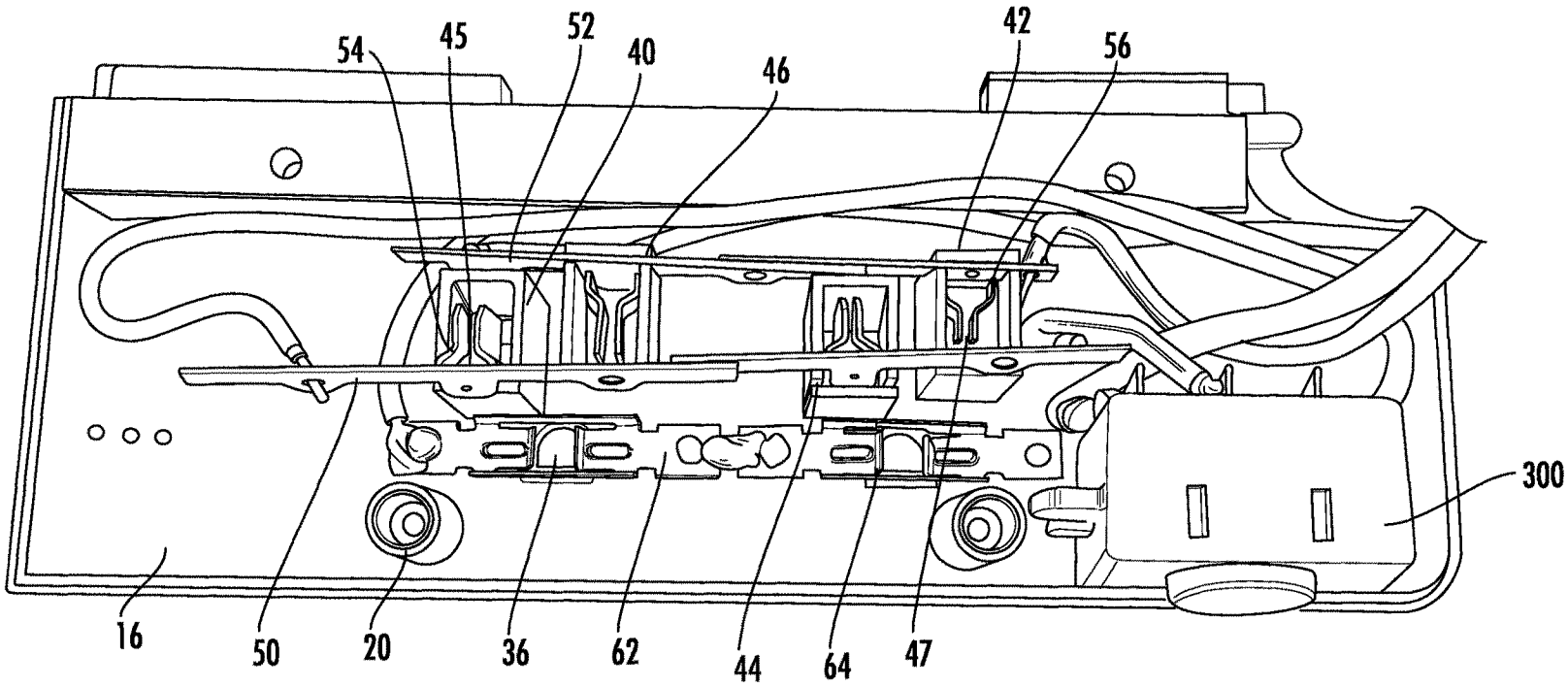
FIG. 4 is a perspective view of one embodiment of the internal structure for the housing members of FIG. 1.
Figure 5:
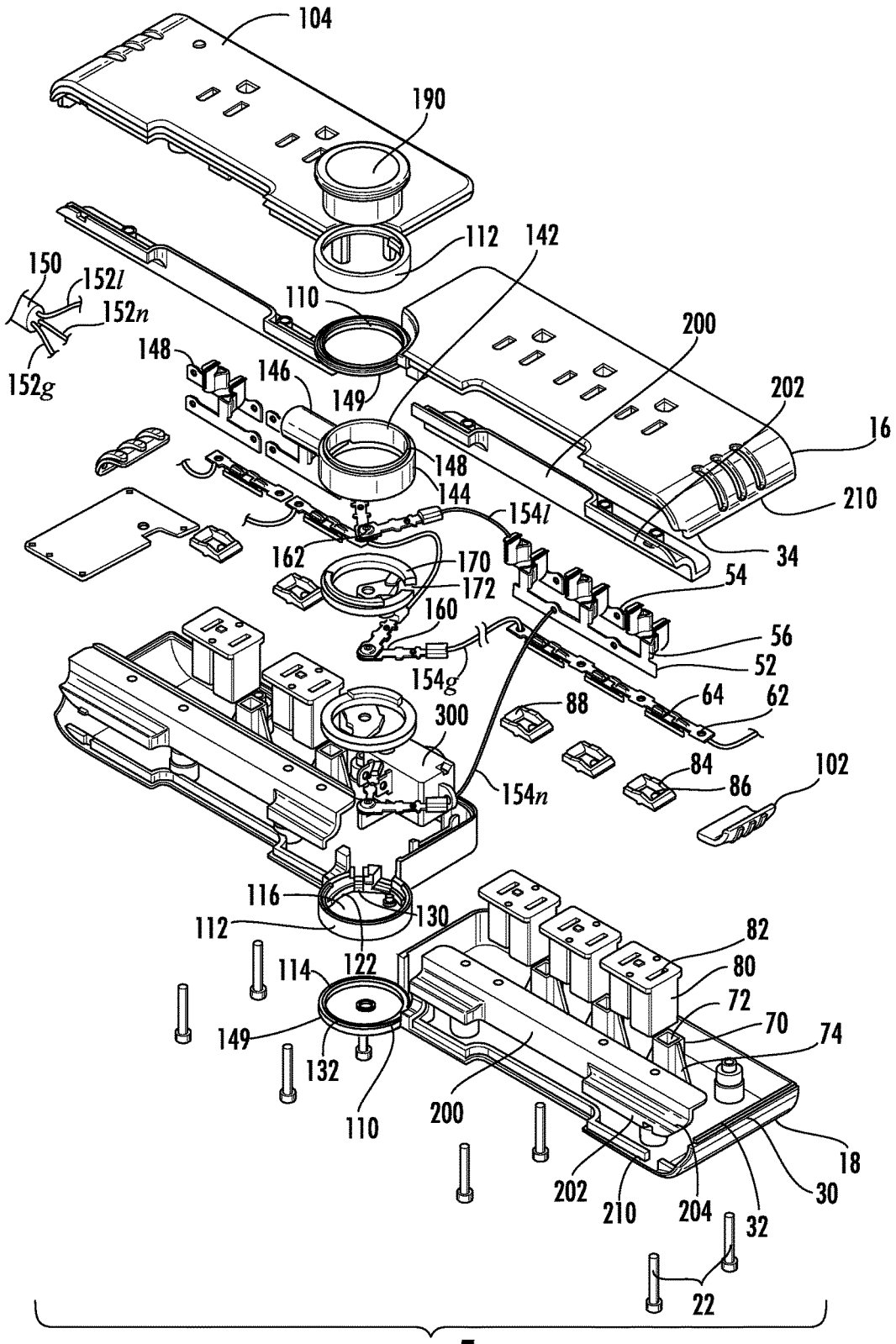
FIG. 5 is an exploded perspective view of the foldable power strip of FIG. 1 showing a second embodiment of the internal structure for the housing members.

Each of the housing members 12, 14 includes a lower portion 16 and an upper portion 18 that may be attached to one another to form the housing. The lower and upper portions may be made out of a variety of materials including, but not limited to, Acrylonitrile Butadiene Styrene ("ABS"). Referring to FIGS. 4 and 5, the lower portions 16 and upper portions 18 may include a plurality of corresponding threaded members 20 for receiving screws 22 through the lower portions 16 to permit the lower portions 16 and upper portions 18 to be attached to one another. In order to assist with the alignment of the lower portions 16 and upper portions 18, the threaded members 20 on the lower portions 16 and upper portions 18 may include a tapered or smaller upper section 24 that can fit within the corresponding upper sections of the opposing threaded member 20. In addition, the upper edge 30 of the lower portions 16 and upper portions 18 may include raised or offset walls or ridges 32 for fitting within corresponding walls or ridges 34 of the opposing lower portions 16 and upper portions 18.

The upper portions 18 include a series of slots 38 and holes 36 for receiving one or more female plugs for electrical devices or appliances. While the power strip shown in the drawings is capable of receiving five 3-prong plugs (three on the first housing member and two on the second housing member), it is appreciated that the power strip may accommodate a different number of and/or types of plugs and not depart from the scope of the present invention.

FIG. 4 shows one embodiment of the internal components for housing the live, neutral and ground bus bars and terminals. The lower portions 16 of the housing members 12, 14 include a series of internal walls 40 defining a plurality of rectangular containers 42, with adjacent containers 42 being located proximate to and slightly offset from one another. Openings 44, 46 at the opposite ends of the adjacent containers 42 define channels for receiving the live hot terminal bus bar 50 and the neutral bus bar 52. The channels are preferably sized such that the bus bars may be press fit and retained therein during use. Connected to each of the live and neutral bus bars 50, 52 are terminals 54, 56 that are sized to fit within the respective containers 42 and which define slots 45, 47 for receiving the elongated narrow plugs of the three prong plug. Ground terminals 64 and bus bars 62 may be positioned within the upper housing portions 18 so that the ground terminals 64 in the bus bar 62 are aligned with the respective holes 36 of the outlet for the ground prongs of the plugs. The bus bars and terminals are made from a conductive material, including but not limited to, copper or other metals.

Referring now to FIG. 5, another embodiment of the internal structure of the housing members is illustrated. The lower portions 16 include a series of raised members 70 that define cavities 72 that are positioned to align with the ground outlet opening 36 of the upper housing portion 18 and the ground terminals 64 when the housing members 12, 14 are connected together. In particular, the ground bus bar 62 rests on top of or over the raised members 70 such that the outlet ground opening 36 is aligned with the ground terminal 64 and the cavity 72 to allow the ground prong of the plug to be inserted therein. The sides of the raised member may include flat vertical flanges 74 extending upward that, together with other raised members 70 on the lower housing portions 16, guide placement of the internal sockets 80 in the power strip housing members for the neutral and live blades of the plug. Each of the interiors of the sockets 80 is sized to receive one of the live terminals 54 and neutral terminals 56 such that the slots 45, 47 defined by the terminals 54, 56 are aligned with the slots or openings 82 of the sockets 80.

In order to help protect against children sticking objects within the sockets, the sockets may be tamper resistant. For example, referring to FIG. 5, the sockets 80 may include rectangular covers 84 that are normally positioned such that at least parts of the covers 84 extend over the openings 82 of the sockets 80. The covers 84 include an opening 86 therein with an angled wall 88 to allow a user to use the prongs of the plug to engage each cover 80 and slide it to reveal the openings 82 in the respective socket 80, thereby allowing the plug to be inserted therein.

The power strip 10 may include a buzzer 100 such as a piezo electric buzzer that can provide an auditory warning for unsafe conditions such as, but not limited to, the power strip 10 not being properly grounded. If a buzzer 100 is utilized, a speaker cover 102 may be used to allow the buzzer 100 to be readily heard outside the power strip 10. In one embodiment, the speaker for the buzzer may produce audible sound in the range of 68-74 decibels. The power strip 10 may also include one or more lights 104 visible from the outside of the power strip housing members 12, 14 to provide information on the status of the power strip 10 and the sockets or outlets 80. For example, 3-5 mm green light emitting diodes ("LEDs") may be used to indicate that power is flowing to a particular outlet, while 3-5 mm red LEDs may be used to warn of potential dangers.

The lower portions 16 and upper portions 18 of the first and second housing members 12, 14 includes circular connectors 110, 112 about adjacent corners to allow the housing members 12, 14 to be rotationally moved relative to one another about a hinge or vertical axis 120. In one embodiment, the circular connector 110, 112 of one of the lower portions 16 and upper portions 18 may include a raised wall 114 that is sized to fit in the opening 116 defined by the other of the circular connector 110, 112 to allow the connectors to be attached to one another. A series of circumferentially spaced-apart nodes 130 or other raised surfaces may be located on one of the outer side of the raised inner wall 114 and the respective inner wall 122 of the other of the circular connectors 110, 112 that may engage detents, slots or other openings or members 132 on the other of the circular connector 110, 112 to permit the housing members 12, 14 to be selectively rotated through and maintained in a series of specific angular positions (e.g., every 12.5 degrees between 0 and 180 degrees).

Referring to FIGS. 1 and 5, the power cord assembly 140 includes a power cord housing 142 and a power cord 150. The power cord housing 142, which may be made out of a variety of materials including but not limited to polyvinyl chloride ("PVC"), comprises an annular ring 144 and a tubular connector 146 extending therefrom to allow the power cord 150 to be rotationally connected to the housing members 12, 14. In the embodiment shown in the drawings, the annular ring 144 is sized to mate with or connect to the respective circular connectors 110, 112 from the housing members 12,14 to allow the power cord 150 and housing members 12, 14 to rotate independently from one another. The connectors 110, 112 and ring 144 may include annular flanges or walls 148, 149 on their tops and/or bottoms that are designed to allow the flanges 148 on the ring 144 to be nested within or on the outside of corresponding flanges 149 on the connectors 110, 112. The power cord 150, which can be a 14/3 power cord with a polyvinyl chloride ("PVC") outer cover is inserted into the tubular connector 146. The wires 1521, 152*n*, 152*g*, namely the live, neutral and ground wires, extend through the center of the annular ring 144 and are connected to separate connector terminals 160 through screws 162 or other known means. Insulating rings 170 or other members are located between the respective connector terminals 160 to prevent them from contacting one another. Separate wires 1541, 154*n*, 154*g* extend from the ends of the connector terminals 160 to attach the live, neutral and ground wires 1521, 152*n*, 152*g* to the live, neutral and ground bus bars 50, 52, 62 and terminals 54, 56, 64 in each of the first and second housing members 12, 14. The insulating ring 170 may include an opening 172 to permit one or more of the wires 1541, 154*n*, 154*g* to extend therethrough to connect to the internal components 50, 52, 62 of the powers strip 10.

Caps or covers 190, 192 may be placed on the bottom and top of the circular connectors 110, 112 to protect the wires and internal components of the power strip. Side members 200 may be attached or extend from the inside walls 210 of the lower and upper members 16, 18 of the first and second housing members 12, 14. Each of the side members 200 includes support members 202 that have a concave or arcuate surface 204 that are aligned with corresponding support members 202 on the other of the upper or lower housing members 16, 18 to define a recess or groove for receiving the power cord 150 when the first and second housing members 12, 14 are rotated into the closed position.

Figure 6:
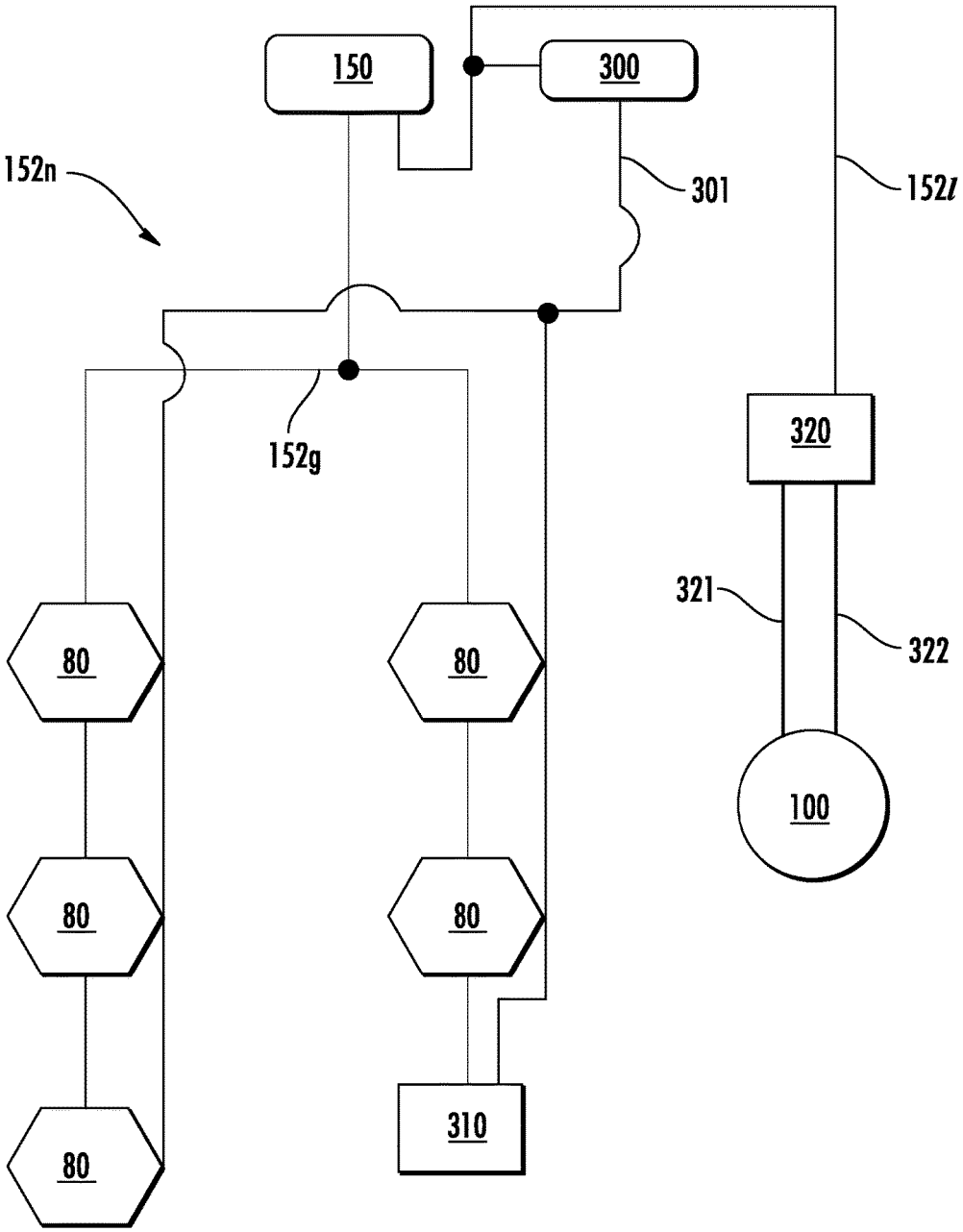
FIG. 6 is a schematic diagram of the foldable power strip of FIG. 1.
Figure 7:
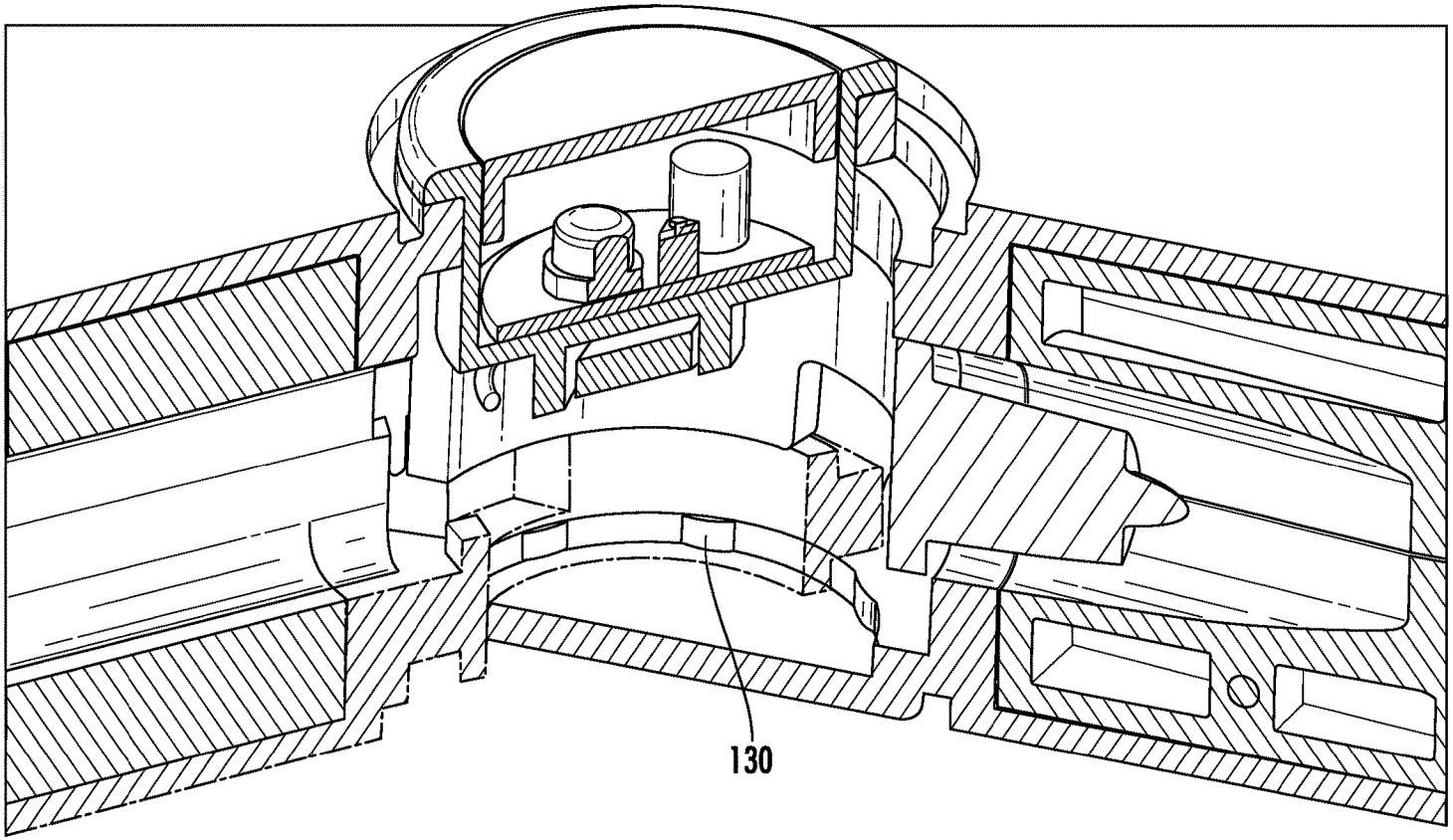
FIG. 7 is a partial sectional view of the hinge of the foldable power strip of FIG. 1.

An electrical schematic diagram of a power strip of the present invention is shown in FIG. 6 as comprising power cord 150, sockets 80, buzzer 100, breaker switch 300, line conditioner 310, and buzzer controller 320. Power cord 150 includes a 3-prong male plug for coupling to a power source such as, in the United States, a 110-volt alternating current source. Each prong of the male plug is operably coupled to an associated wire or conductor, namely neutral conductor 152*n*, live conductor 1521, and ground conductor 152*g*. Breaker switch 300, coupled to live conductor 1521, may be an illuminated, single pole, single throw ("SPST") type switch, enabling the user to manually switch power to sockets 80 on and off. Moreover, breaker switch 300 may include a solid-state circuit breaker and an associated over-voltage or other abnormal condition sensor, automatically switching breaker switch 300 from the on (closed, or conducting) to the off (open, or non-conducting) state whenever an over-voltage or other predetermined abnormal condition is detected.

Output 301 of breaker switch 300 is coupled to the live terminals of each socket 80, and to the live inputs of line conditioner 310 and buzzer controller 320. Neutral conductor 152*n* is coupled to the neutral terminals of each socket 80, and to the neutral inputs of line conditioner 310 and buzzer controller 320. Ground conductor 152*g* is coupled to the ground terminals of each socket 80.

Line conditioner 110 may include conventional surge suppression and/or Electromagnetic interference/radio frequency interference ("EMI/RFI") filtering circuitry, to protect electrical appliances, equipment or devices plugged into any of sockets 80 from anomalies in the source power received by power cord 150. Buzzer controller 320 may include sensors to detect one or more alarm conditions. Upon the detection of such a condition, buzzer controller activates buzzer 100, which may be, for example, a piezoelectric speaker, via conductors 321 and 322. In one embodiment of the invention, buzzer controller 320 may include a sensor disposed within or proximate the male plug of power cord 150, sensing an improperly grounded power connection. In another embodiment of the invention, buzzer controller 320 may include a sensor disposed within or proximate the male plug of power cord 150, sensing excess heat proximate the male plug of the power cord in excess of a predetermined alarm threshold, such as, for example, approximately 125° Fahrenheit. Regardless of the type of abnormal condition sensed, the sensing of an abnormal condition by buzzer controller 320 will cause activation of buzzer 100 via conductors 321 and 322. Buzzer controller may cause buzzer 100 to emit a continuous sound upon the detection of an alarm condition. Alternatively, buzzer controller may cause buzzer 100 to be activated in a pulsed manner, or in a manner that rises, falls, or alternates in frequency. Furthermore, buzzer 100 may instead be a higher fidelity speaker, and buzzer controller may include a voice synthesizer or stored speech, enabling one or more spoken warnings to be emitted upon the detection of an alarm condition.

In operation, the housing members 12, 14 and power cord assembly 140 may be rotated independent of one another about the vertical axis 120 to allow them to be positioned in a variety of positions relative to one another to allow the power strip 10 to be adjusted for more efficient use in a variety of locations. When the power strip 10 is in the fully closed or folded position, the power cord 150 will extend along the length of the inside walls 210 of the power strip housing members 12, 14 and be retained therein through support members 202 to protect the power cord housing 142 during use.

It will be understood that modifications and variations may be effected without departing from the spirit and scope of the present invention. It will be appreciated that the present disclosure is intended as an exemplification of the invention and is not intended to limit the invention to the specific embodiment illustrated and described. The disclosure is intended to cover, by the appended claims, all such modifications as fall within the scope of the claims.

The invention claimed is:

1. A foldable power strip comprising:

a first power strip housing member having at least one outlet and a pivotable connector for rotating about a vertical axis;

a second power strip housing member having at least one outlet and a pivotable connector for rotating about the vertical axis, the power strip housing members rotated between a fully open and a closed position;

a power cord; and a power cord connector for rotationally connecting the power cord about the vertical axis relative to the first and second power strip housing members, the power cord extending in between the power strip housing members in the closed position;

wherein the first power strip housing member, the second power strip housing member and the power cord connector are all independently rotatable relative to one another about the vertical axis.

2. The foldable power strip of claim 1 wherein the power cord connector comprises an annular ring and a tubular member extending therefrom.

3. The foldable power strip of claim 1 wherein the first and second housing members are rotated through a series of set positions.

4. The foldable power strip of claim 3 wherein the set positions are 12.5 degrees apart.

5. The foldable power strip of claim 1 wherein each of the first and second housing members comprises at least two outlets.

6. The foldable power strip of claim 1 wherein the power cord comprises a live wire, a neutral wire and a ground wire and wherein the foldable power strip further comprises three terminal connectors having an input for receiving the live, neutral and ground wires and a first output for connecting to the at least one outlet of the first power strip housing member and a second output for connecting to the at least one outlet of the second power strip housing member.

7. The foldable power strip of claim 6 wherein the terminal connectors are vertically stacked relative to one another and which further comprises an insulator positioned between adjacent terminal connectors.

8. A foldable power strip comprising:

a first power strip housing member having at least one outlet and a pivotable connector for rotating about a vertical axis;

a second power strip housing member having at least one outlet and a pivotable connector for rotating about the vertical axis;

a power cord; and a power cord connector for rotationally connecting the power cord about the vertical axis relative to the first and second power strip housing members;

wherein the first and second power strip housing members further comprise inside walls and side members extending from the inside walls to define a passageway for retaining the power cord between the housing members when the housing members are in the closed position;

wherein the first power strip housing member, the second power strip housing member and the power cord connector are all independently rotatable relative to one another about the vertical axis; and wherein the first and second housing members are rotated between a fully open and a closed position.

9. A foldable power strip comprising:

a first power strip housing member having at least one outlet and a pivotable connector for rotating about a vertical axis;

a second power strip housing member having at least one outlet and a pivotable connector for rotating about the vertical axis, the first and second power strip housing members rotated between an open and a closed position and wherein the first and second power strip housing members further comprise inside walls with side members extending from the insides walls to define a passageway;

a power cord; and a power cord connector for rotationally connecting the power cord about the vertical axis relative to the first and second power strip housing members, the power cord connector comprising an annular ring and a tubular member extending therefrom;

wherein the first power strip housing member, the second power strip housing member and the power cord connector are all independently rotatable relative to one another about the vertical axis; and wherein the power cord may be retained within the passageway when the first and second housing members are rotated into the closed position.

10. The foldable power strip of claim 9 wherein the first and second housing members are rotated through a series of set positions.

11. The foldable power strip of claim 10 wherein the set positions are 12.5 degrees apart.

12. The foldable power strip of claim 9 wherein each of the first and second housing members comprises at least two outlets.

13. The foldable power strip of claim 9 wherein the power cord comprises a live wire, a neutral wire and a ground wire and wherein the foldable power strip further comprises three terminal connectors having an input for receiving the live, neutral and ground wires and a first output for connecting to the at least one outlet of the first power strip housing member and a second output for connecting to the at least one outlet of the second power strip housing member.

14. The foldable power strip of claim 13 wherein the terminal connectors are vertically stacked relative to one another and which further comprises an insulator positioned between adjacent terminal connectors.

* * * * *